US006010200A

United States Patent [19]

Hays

[11] Patent Number: 6,010,200

[45] Date of Patent: Jan. 4, 2000

[54] ADAPTER RAIL FOR PLASTIC DRAWER

[75] Inventor: Robert E. Hays, Alma, Mich.

[73] Assignee: R&R Technologies, LLC, Alma, Mich.

[21] Appl. No.: 09/160,854

[22] Filed: Sep. 25, 1998

[51] Int. Cl.[7] ..... A47B 88/00

[52] U.S. Cl. ..... 312/334.7; 312/334.6; 312/334.12

[58] Field of Search ..... 312/330.1, 334.12, 312/334.14, 334.15, 334.21, 334.27, 334.42, 334.6, 334.7, 334.8, 334.9, 350, 404

[56] References Cited

U.S. PATENT DOCUMENTS

| | | | |
|---|---|---|---|
| 3,059,986 | 10/1962 | Miller, Jr. | 312/334.8 |
| 3,698,782 | 10/1972 | Onori | 312/350 |
| 4,863,288 | 9/1989 | Houck | 312/334.6 X |
| 4,936,641 | 6/1990 | Bussan et al. | 312/350 X |
| 5,671,989 | 9/1997 | Lautenschlager | 312/330.1 X |

*Primary Examiner*—Anthony Knight
*Assistant Examiner*—Karlena D. Schwing
*Attorney, Agent, or Firm*—Reising, Ethington, Barnes, Kisselle, Learman & McCulloch, PC

[57] ABSTRACT

An adapter rail is provided for an injection molded plastic drawer to compensate for the draft angle of the sidewalls of the plastic drawer and to dispose a runner attached to the adapter rail aligned with and substantially parallel to a track mounted in an opening into which the drawer is inserted. In use, an adapter rail is attached to each of a pair of opposed sidewalls of a plastic drawer and a runner is attached to each adapter rail. Each adapter rail has a first side which is inclined at a complementary angle to the sidewall of the drawer to which it is attached to dispose a second side of the adapter rail generally parallel to the track. The adapter rail also spaces the runner from the sidewall of the drawer so that the runner is aligned with and can be mated with the track. Thus, a plastic drawer with the adapter rail and attached runner may be used with conventional track and within an opening of a cabinet having generally straight sides and being defined by right angles.

11 Claims, 2 Drawing Sheets

ADAPTER RAIL FOR PLASTIC DRAWER

FIELD OF THE INVENTION

This invention relates generally to plastic drawers and more particularly to a plastic drawer and an adapter rail constructed to be used with conventional runners and tracks.

BACKGROUND OF THE INVENTION

Metal or wood drawers slidably received in a cabinet desk or the like are well known. These drawers have a bottom wall and four upstanding sidewalls extending from the bottom wall at right angles. A pair of runners attached to opposed sidewalls of a drawer are each received in a separate track mounted in an opening which receives the drawer to slidably receive and guide the door for reciprocation into and out of the opening.

A plastic drawer formed by injection molding also has a bottom wall and four sidewalls. Plastic drawers are easy to clean, inexpensive to manufacture and are very durable. However, to facilitate removing a plastic drawer from an injection mold after it has been formed, a draft angle is provided between the sidewalls and the bottom wall such that the sidewalls extend from the bottom wall at an obtuse included angle. Thus, sidewalls of the plastic drawer are inclined relative to the adjacent walls of a substantially rectangular opening of a cabinet or the like in which the drawer is to be received. Therefore, any runner attached to the sidewall of the drawer would also be inclined relative to a track mounted in the drawer opening and would not fit or operate correctly with the track. Further, the opening must be of a size sufficient to receive the widest portion of the drawer and a runner attached directly to a more narrow portion of a sidewall of the drawer would not mate with a corresponding track in the opening.

SUMMARY OF THE INVENTION

An adapter rail is provided for an injection molded plastic drawer to compensate for the draft angle of the sidewalls of the plastic drawer and to dispose a runner attached to the adapter rail in a position such that it is aligned with and substantially parallel to a track mounted in an opening into which the drawer is inserted. In use, an adapter rail is attached to each of a pair of opposed sidewalls of a plastic drawer and a runner is attached to each adapter rail. Each adapter rail has a first side which is inclined at a complementary angle to the sidewall of the drawer to which it is attached to dispose a second side of the adapter rail generally parallel to the track. The adapter rail also spaces the runner from the sidewall of the drawer so that the runner is aligned with and can be mated with the track. Thus, a plastic drawer with the adapter rail and attached runner may be used with conventional track and within an opening of a cabinet having generally straight sides and being defined by right angles.

Objects, features and advantages of this invention include providing an adapter rail for an injection molded plastic drawer to facilitate use of the plastic drawer within a conventional drawer opening, permits use of conventional runners and tracks, is of relatively simple design and economical manufacture and assembly onto the plastic drawer, is rugged, durable and has a long useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
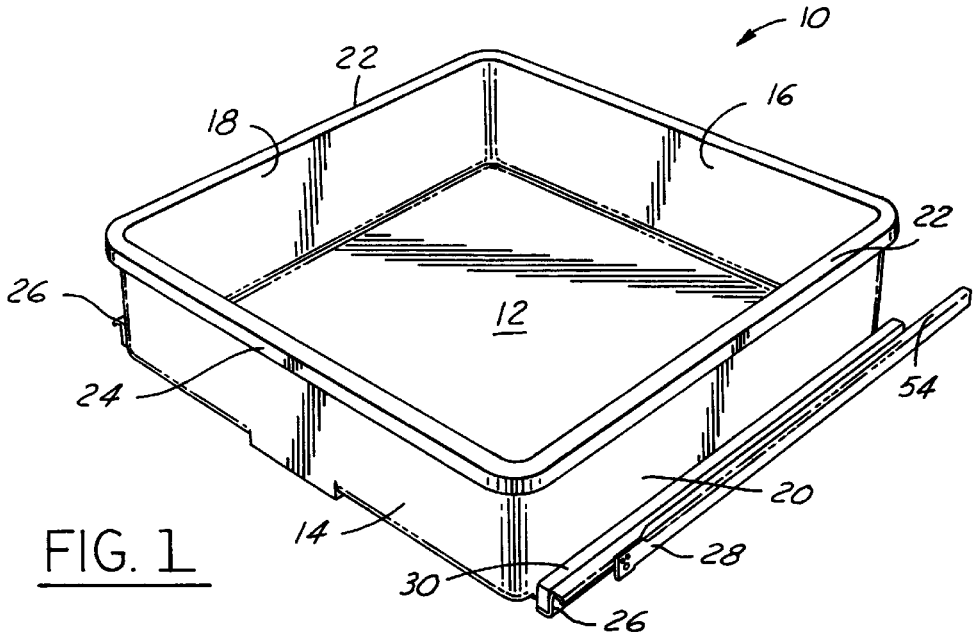
FIG. 1 is a perspective view of a plastic drawer having an adapter rail embodying this invention.

Referring in more detail to the drawings, FIG. 1 illustrates an injection molded plastic drawer 10 having a bottom wall 12 and generally upstanding front 14, back 16 and sidewalls 18,20. To facilitate removing the plastic drawer 10 from a mold after it is formed, the sidewalls 18,20 have a draft angle or are inclined at an obtuse included angle relative to the bottom wall. Thus, an upper edge 22 of the sidewalls 18,20 is disposed slightly outwardly relative to a lower portion of the sidewall adjacent to the bottom wall 12. The drawer 10 preferably has an outwardly and downwardly extending upper rim 24 which defines the widest portion of the drawer 10 and hence, the minimum width of an opening into which the drawer can be received. The drawer 10 also preferably has a depending flange 25 extending along each of its sidewalls 18,20 beneath the bottom wall 12. The flanges 25 are downwardly extended portions of the sidewalls 18,20 and have the same draft angle relative to the bottom wall 12.

A pair of runners 26 carried by the drawer 10 are constructed to mate with tracks 28 mounted on opposed walls of a generally rectangular opening of a cabinet, desk or the like to guide the door for reciprocation into and out of the opening. According to the present invention, to properly orient the runners 26 relative to the tracks 28 an adapter rail 30 is provided between the drawer 10 and each runner 26 to compensate for the draft angle of the sidewalls 18,20 and also to space the runners 26 outwardly from the lower edge or flange 25 of the sidewalls 18,20 and generally aligned with the rim 24 which defines the minimum width of an opening in which the drawer 10 can be received.

Figure 2:
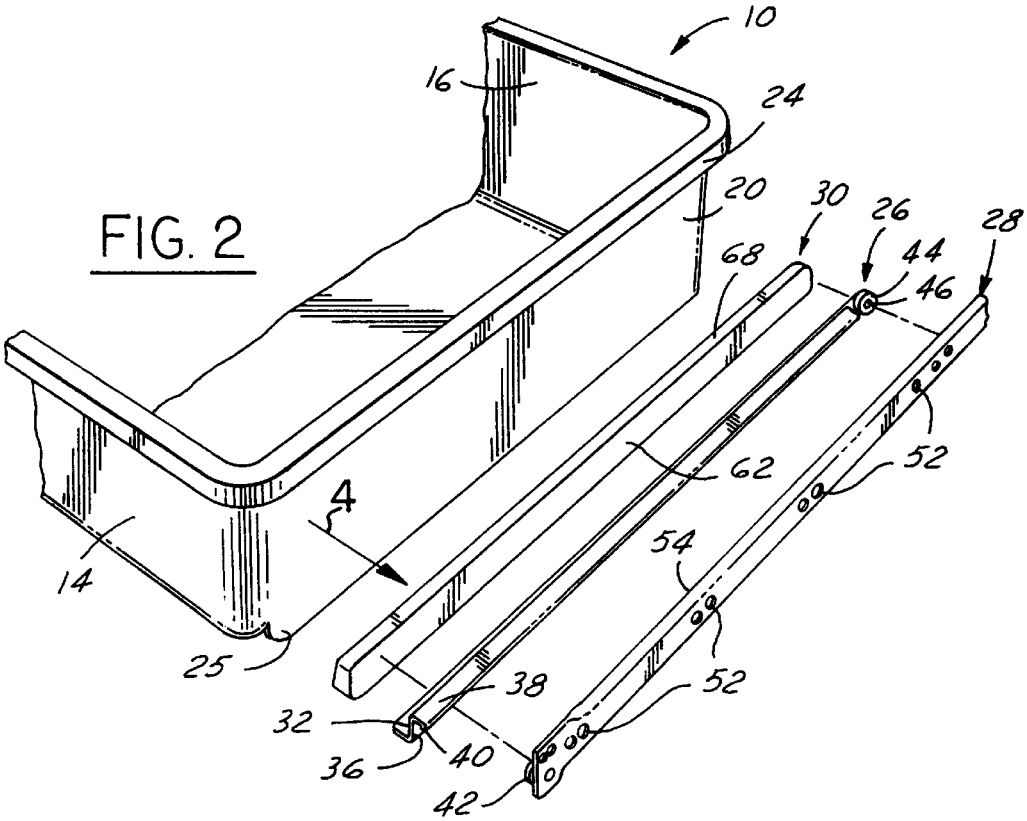
FIG. 2 is a fragmentary exploded view illustrating the location of the adapter rail and runner relative to the plastic drawer and a track in which the runner is received.

As shown in FIG. 2, the runners 26 are generally elongate and preferably extend along substantially the entire length of the sidewalls 18,20. The runners 26 are generally S-shaped in cross-section and have an L-shaped inside surface 32 constructed to receive an adapter rail 30 which is preferably secured thereto with one or more self-tapping screws 34 as shown in the right hand portion of FIG. 3. The other side of the runners 26 have an upright sidewall portion 36 and an upper wall 38 with a return bend providing a depending rim 40 constructed to receive a wheel 42 of the track 28 which locates the runner 26 and guides it for reciprocation along the track 28. To also locate the runner 26 and guide it for reciprocation along the track 28, a wheel 44 disposed at the rear end of the runner 26 is journalled for rotation on a shaft 46 fixed to the runner 26 and is constructed to be rotatably and slidably received within the track 28.

Figure 5:
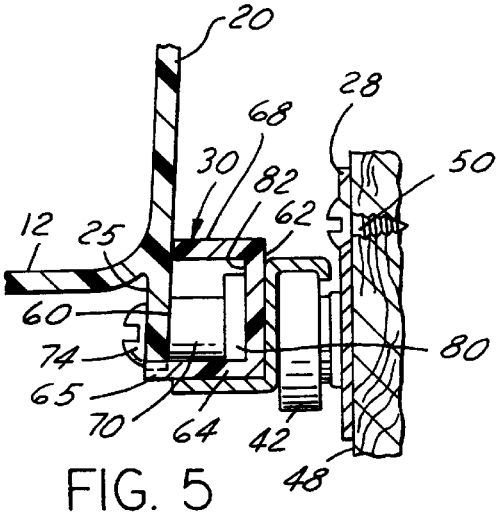
FIG. 5 is a fragmentary sectional view illustrating a plastic drawer having an adapter rail embodying this invention and a runner attached to the adapter rail slidably received for reciprocation along a track.

The track 28 is preferably a conventional track used with wood or metal drawers and, as shown in FIG. 5, is fixed to a generally upright, planar inside surface 48 of an opening into which the plastic drawer 10 is received by a plurality of screws 50 received through holes 52 in the track 28. The track also has an upper surface 54 and an opposed lower surface (not shown) to receive and retain the wheel 44 of the runner therein as the drawer 10 is moved within the opening.

Each adapter rail 30 is an elongate body preferably injection molded from a polymeric material, such as polystyrene. Each adapter rail 30 has a first side 60 constructed to be received against the flange 25 of a sidewall 18 or 20 of the drawer 10 which is generally parallel to the sidewall 18,20 of the drawer to which it is attached and a second side 62 inclined relative to the first side 60 to dispose the second side 62 generally perpendicular to the bottom wall 12 of the drawer 10. With this first side 60 of the adapter rail thus flush against the flange 25 of the sidewall 18 or 20 of the drawer 10, the first side 60 is inclined relative to the bottom wall 12 of the drawer 10 at the same obtuse angle as the flange 25. To locate the adapter rail adjacent to the flange 25, a bottom wall 64 of the adapter rail 30 preferably has a lip 65 constructed to underlie the flange 25 in assembly.

Figure 3:
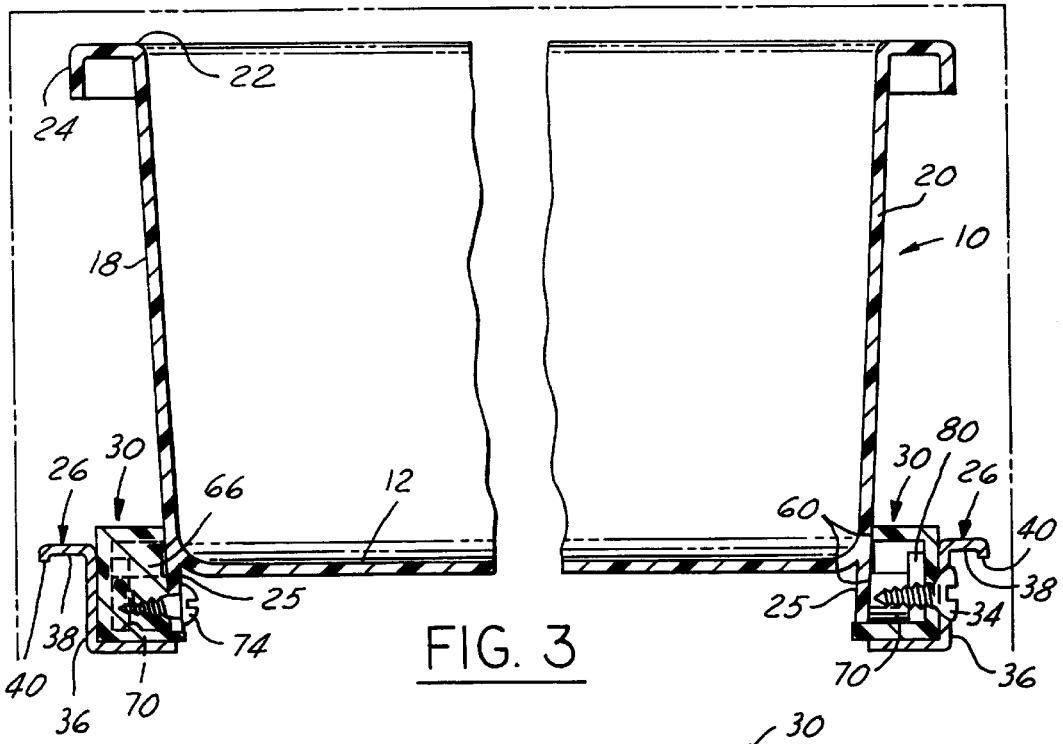
FIG. 3 is a sectional view of a plastic drawer with parts broken away illustrating both the interconnection between the adapter rail and the drawer and the interconnection between the runner and the adapter rail.
Figure 4:
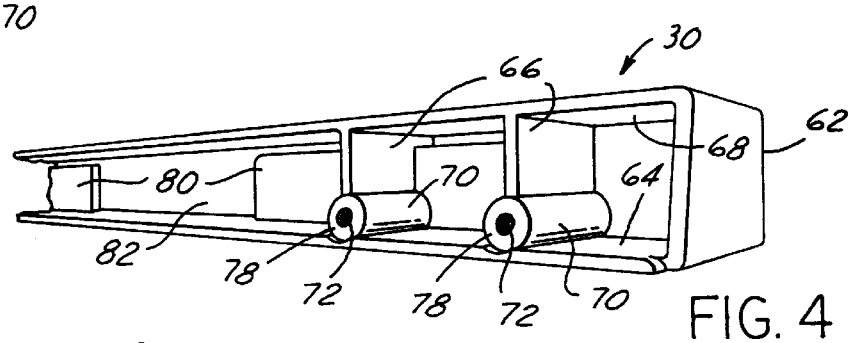
FIG. 4 is an enlarged fragmentary perspective view of an adapter rail embodying this invention.

As best shown in FIG. 4, the adapter rail 30 is preferably generally hollow and substantially open along its first side 60. A plurality of ribs 66 interconnect an upper wall 68 and bottom wall 64 of the adapter rail 30 and have generally cylindrical screw receiving portions 70 adjacent the bottom wall 68. Each screw receiving portion 70 has a blind bore 72 formed therein constructed to receive a self-tapping screwing 74 inserted through the flange 25, as shown in the left hand portion of FIG. 3. Thus, the first side 60 of the adapter rail 30 which engages the sidewall 18,20 of the drawer 10 in assembly is preferably defined by an inside edge 76 of the upper wall 68 and an inside edge 78 of the screw receiving portions 70 which engage the sidewall 18,20 in assembly to orient the adapter rail 30 relative to the drawer 10, as shown in the right hand portion of FIG. 3 and in FIG. 5.

The second side 62 of an adapter rail 30 is preferably generally planar and continuous to facilitate attaching the runners 26 to the adapter rails 30 with self-tapping screws 34 inserted through the runners and through the second side 62 of the adapter rails 30, as shown in the right hand portion of FIG. 3. Spaced apart reinforcing sections 80 may be formed on an inside wall 82 of the adapter rails 30 to provide an increased wall thickness to more securely receive and retain the screws 34 connecting the runner 26 to the adapter rail 30.

The adapter rails 30 have a width defined between their first side and second side sufficient to space the runners 26 outwardly from the sidewalls 18,20 so that the runners 26 may engage the tracks 28 in an opening of a size sufficient to receive the relatively wide upper rim 24 portion of the drawer 10. Thus, the adapter rails 30 both space the runners 26 from the relatively narrow lower portion of the drawer to which they are attached and also properly orient the runners 26 generally parallel to the tracks 28 for proper engagement of the runners 26 with the tracks 28.

The adapter rails 30 thus permit use of a plastic drawer 10 within a conventional, generally rectangular opening having conventional tracks 28 therein constructed to locate and guide the drawer 10 for reciprocation within the opening. The adapter rails 30 space the runners 26 sufficiently from the relatively narrow bottom of the drawer 10 so that the runners 26 may engage the tracks 28 disposed in a wider opening and also orient the runners 26 generally parallel to the tracks 28. The adapter rails 30 are of relatively low cost and are of relatively simple design and economical manufacture and assembly onto the plastic drawers 10.

What is claimed is:

1. A plastic drawer constructed to be received in a generally rectangular opening, comprising:

a drawer portion formed of plastic and having a bottom wall and first and second upstanding sidewalls inclined at an obtuse included angle from said bottom wall;

a pair of adapter rails attached to said respective first and second sidewalls of said drawer, each of said adapter rails having a first side constructed to be received against one of the sidewalls of the drawer and extending generally parallel thereto and a second side inclined relative to said first side to dispose said second side generally perpendicular to said bottom wall of said drawer;

each of said adapter rails having a top wall and a bottom wall, the first side of each of said adapter rails being defined by a side edge of the top wall and at least one stop surface between the top wall and the bottom wall, and a screw receiving portion of each of the adapter rails between the top wall and bottom wall thereof constructed to receive a screw attaching the adapter rail to one of the sidewalls of the drawer and each of the stop surfaces being provided by a screw receiving portion.

2. A plastic drawer constructed to be received in a generally rectangular opening, comprising:

a drawer portion formed of plastic and having a bottom wall and first and second upstanding sidewalls inclined at an obtuse included angle from said bottom wall;

a pair of adapter rails attached to said respective first and second sidewalls of said drawer, each of said adapter rails having a first side constructed to be received against one of the sidewalls of the drawer and extending generally parallel thereto and a second side inclined relative to said first side to dispose said second side generally perpendicular to said bottom wall of said drawer, and a runner attached to each of said adapter rails adjacent the second side of each of said adapter rails, each said runner constructed to be mated with a track of the opening in which the drawer is received.

3. The plastic drawer of claim 2 wherein each of said adapter rails has a body which is elongate and constructed to extend along substantially an entire one of the sidewalls of the drawer.

4. The plastic drawer of claim 2 wherein each of said adapter rails has a body provided with a top wall having an inside edge and the first side is defined in part by the inside edge of the top wall.

5. The plastic drawer of claim 4 wherein the body of each of said adapter rails also has at least one screw receiving portion constructed to receive a screw attaching the adapter rail to one of the sidewalls of the plastic drawer and the first side of each of the adapter rails is defined in part by a screw receiving portion.

6. The plastic drawer of claim 2 wherein each of the adapter rails has a body provided with a bottom wall which has a lip extending beyond a side of the body.

7. A drawer constructed to be received in a generally rectangular opening:

said drawer having a bottom wall, first and second upstanding sidewalls, a front wall and a rearwall, elongated first and second adapter rails attached to the respective sidewalls of said drawer, said adapter rails extending from said front wall to said rear wall, and an elongated runner attached to each of said adapter rails, said runners being constructed and adapted to run on tracks in the opening in which the drawer is received.

8. The drawer of claim 7, wherein each of said sidewalls has a portion thereof extending beneath the bottom wall, said portions of said sidewalls forming flanges to which said adapter rails are attached.

9. A plastic drawer adapted to be received in a generally rectangular opening, said drawer having a bottom wall, first and second upstanding sidewalls, a front wall and a rear wall, said sidewalls flaring laterally outwardly and upwardly from said bottom wall, elongated first and second adapter rails extending from said front wall to said rear wall and secured to the respective sidewalls in positions adjacent to said bottom wall, and an elongated runner extending lengthwise of and secured to each of said adapter rails, said runners being constructed and adapted to run on tracks in the opening in which the drawer is received.

10. The drawer of claim 9, wherein each of said sidewalls has a portion thereof extending beneath the bottom wall, said portions of said sidewalls forming flanges to which said adapter rails are attached.

11. The drawer of claim 10, wherein said adapter rails have lips which at least partially underlie the flanges to which the adapter rails are attached to locate the adapter rails in assembly.

* * * * *